United States Patent [19]

Harms et al.

[11] Patent Number: 4,648,780

[45] Date of Patent: Mar. 10, 1987

[54] TRUCK MOUNTED BACKHOE

[75] Inventors: John R. Harms; Ronald L. Anderson, both of Burlington, Iowa

[73] Assignee: J. I. Case Company, Racine, Wis.

[21] Appl. No.: 769,035

[22] Filed: Aug. 26, 1985

[51] Int. Cl.[4] ..... B66F 9/00

[52] U.S. Cl. ..... 414/686; 212/189

[58] Field of Search ..... 414/685, 686, 687, 694, 414/550, 563; 280/402; 212/182, 186, 187, 188, 189

[56] References Cited

U.S. PATENT DOCUMENTS

| | | | |
|---|---|---|---|
| 2,897,986 | 8/1959 | Davis | 414/686 |
| 3,027,026 | 3/1962 | Couquet | 414/694 |
| 3,282,452 | 11/1966 | Parsen | 414/694 |
| 3,795,332 | 3/1974 | Eriksson | 414/550 X |
| 4,383,791 | 5/1983 | King | 414/680 X |

*Primary Examiner*—Robert J. Spar

*Assistant Examiner*—Donald W. Underwood

*Attorney, Agent, or Firm*—Cullen, Sloman, Cantor, Grauer, Scott & Rutherford

[57] ABSTRACT

The present invention relates to a truck mounted backhoe supported by a frame that pivots between a use position and a transport position in an uninterrupted movement. The support frame is interconnected to the truck by a linkage assembly having two links pivotally connected at adjacent ends with the opposite ends connected to the frame and the truck respectively. A hydraulic cylinder is connected at the adjacent connecting point to push and pull the frame between the use and transport positions. Further, a control station is provided which is pivotally interconnected with the support frame and is moved with respect to the frame as the frame moves between the use and transport position to prevent interference with the backhoe. A bracing frame is provided to retain the frame in a substantially vertical position when in use.

5 Claims, 5 Drawing Figures

TRUCK MOUNTED BACKHOE

BACKGROUND OF THE INVENTION

The present invention relates to a mounting system for attaching implements to the rear portion of a pick-up truck. More particularly, the present invention relates to a backhoe that can be mounted to a pick-up truck and readily transported between job sites.

An attempt to provide such a backhoe is disclosed in U.S. Pat. No. 2,897,986, which illustrates a backhoe mounted to a flat bed truck. The backhoe is moveable from a working position adjacent the edge of the truck bed to a transport position folded over the truck bed.

The backhoe and an operator station are supported by a cradle carriage that is rockable about a transverse pivot axis between a vertical position, corresponding to the working position, and a horizontal position, corresponding to the first stage of the transport position wherein the backhoe and the station hang over the rear of the truck bed. From the first stage of the transport position, the carriage is longitudinally movable within a rigid frame having two parallel channel slideways or rails to the final stage when the backhoe and station are completely on the truck bed.

In operation, a hydraulic valve actuator is manipulated and through cradle rocking cylinders the cradle is rocked to the horizontal position. Next, a second hydraulic actuator is manipulated and through a second cradle cylinder the cradle carriage is moved forwardly toward the truck cab. To facilitate movement, the carriage is fitted near each of its four corners with identical rollers.

To return the shuttle and operator seat to the vertical position or working position, the above process is reversed. Once in the vertical position the carriage is locked with respect to the truck by braces and fixed anchor brackets secured to the end of the truck frame.

There are several problems associated with this apparatus. First, to rock the carriage from the working position to the transport position, the operator must leave his control station and move to the forward end of the truck bed. Additionally, to move the backhoe between the work and transport positions, two sets of hydraulic cylinders are required, one to rock the backhoe and operator station from a vertical to a horizontal position and a second set to complete the cycle by pulling the backhoe and operator station forwardly into the truck bed.

A further problem with this apparatus is the use of the parallel channel slideways or rails between which the carriage is moveable longitudinally. Corrosion and dirt build up, which are characteristic of the environment where backhoes are used, may interfere with the operation of the rails. Additionally, maintenance of the rollers become expensive and if not properly maintained a breakdown could occur in the system. A still further problem with this system is the necessity of connecting and disconnecting the braces which support the carriage with respect to the truck. They are prone to corrosion and the build up of dirt, etc., which may interfere with operation, leading to down time of the equipment.

SUMMARY OF THE INVENTION

The present invention overcomes the above disadvantages by providing a truck mounted backhoe having a sub-frame which is readily attachable to the truck bed for supporting a backhoe support frame. The support frame pivots the backhoe between a use and a transport position by a single set of cylinders and in a manner that requires less maintenance. A control station is provided from which all backhoe movement may be controlled without leaving the station.

The backhoe support frame is pivotally mounted to the sub-frame adjacent the rear of the truck bed. It has opposed side members and a pivot for operatively supporting the boom of the backhoe. The frame can be pivoted between a use position, wherein the side members extend downwardly substantially perpendicular to the truck bed with the backhoe being extendable rearwardly for use, and a transport position, wherein the side members extend upwardly essentially perpendicular to the truck bed with the backhoe being foldable over the bed for transport.

First and second linkages pivotally joined at adjacent ends interconnect the support frame with the sub-frame. A hydraulic cylinder is connected to the adjacent ends of the linkages to push and pull the frame between the use and transport positions. In this manner, the backhoe may be pivoted between the use and transport positions in an uninterrupted movement.

A control station which is positioned adjacent the rear of the truck bed operatively controls the implement in the use position and controls the frame as it is pivoted between the use and transport positions. In the preferred embodiment, the control station is mounted such that it moves upwardly and forwardly with respect to the rear of the truck as the backhoe is moved from the use to the transport positions and moves rearwardly and downwardly when the backhoe is moved from the transport to the use positions. This prevents interference between the control station and the boom allowing the operator to remain seated at all times.

A fixed brace member, which limits movement of the support frame while in the use position, extends downwardly from the sub-frame. To prevent further movement of the support frame, stabilizers are provided and extend to the ground when the frame is in the use position.

DETAILED DESCRIPTION OF THE INVENTION

Figure 1:
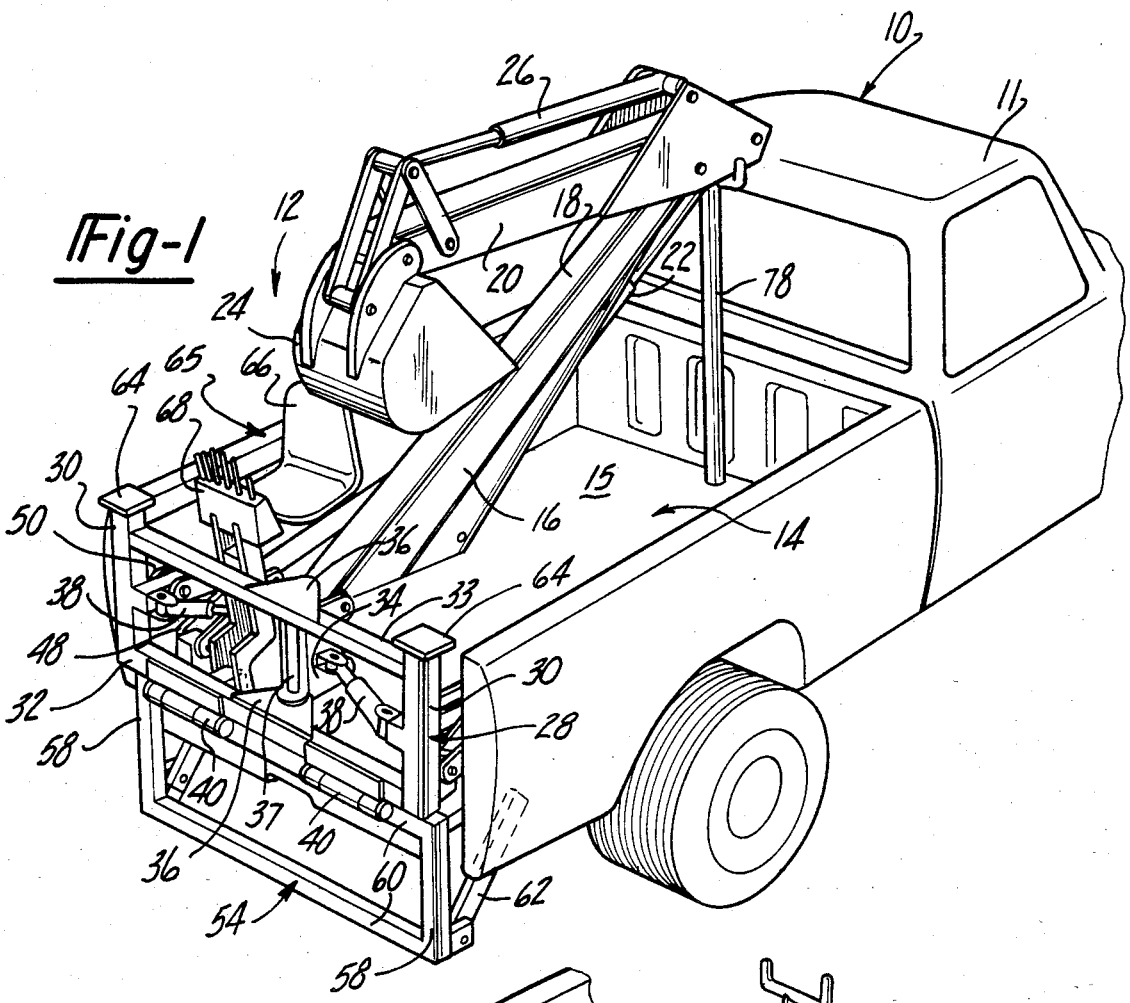
FIG. 1 is a partial perspective view of the pick-up truck mounted backhoe in the transport position.
Figure 2:
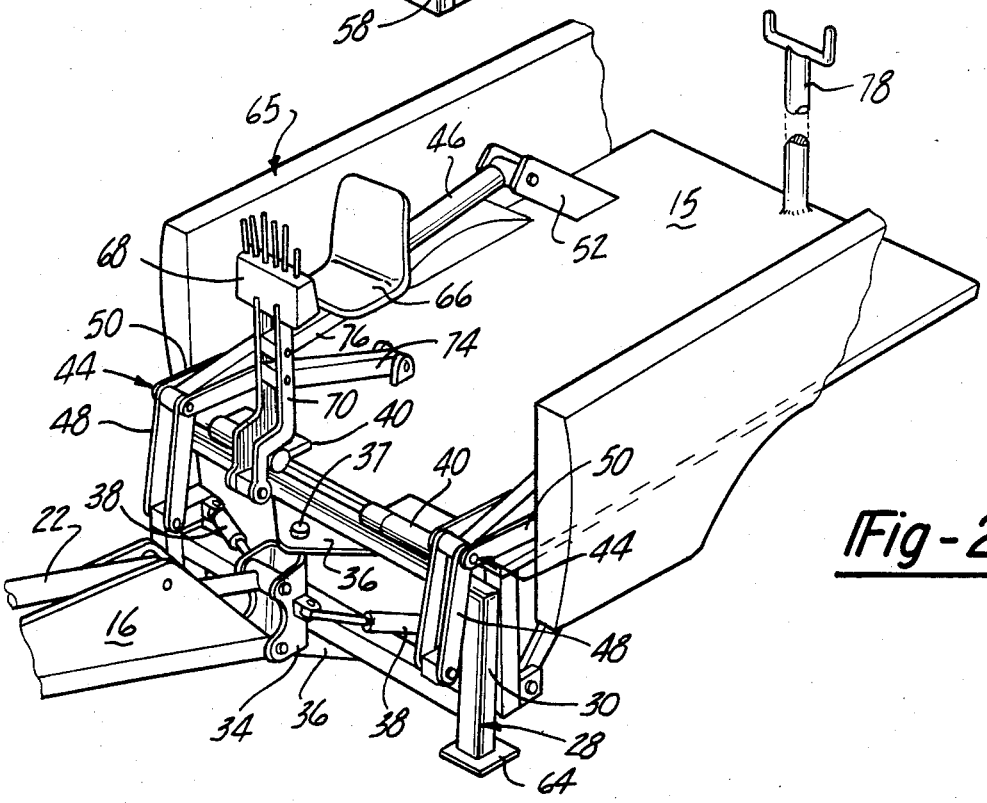
FIG. 2 is a partial perspective view of the backhoe in the use position.
Figure 3:
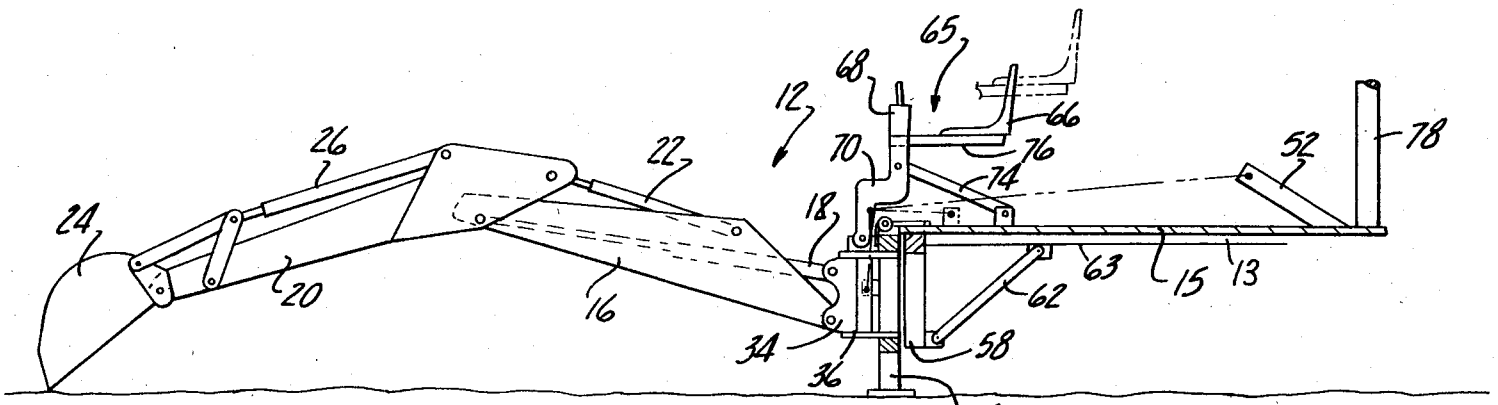
FIG. 3 is a partial side view of the backhoe in the use position.
Figure 5:
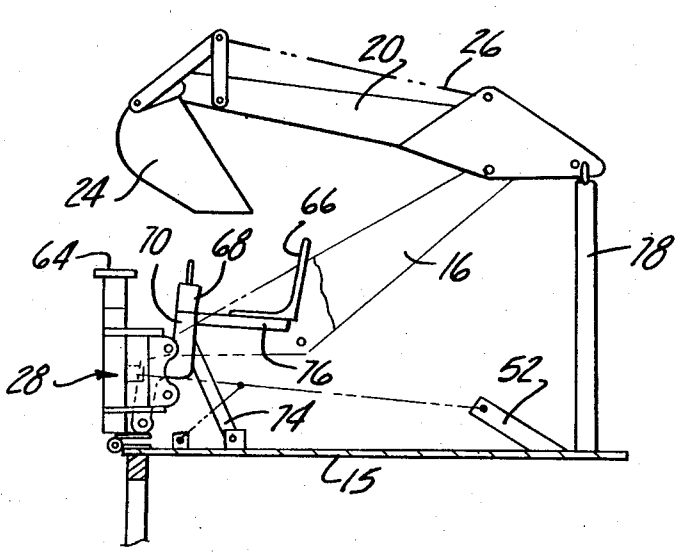
FIG. 5 is a partial side view of the backhoe in the transport position.
Figure 4:
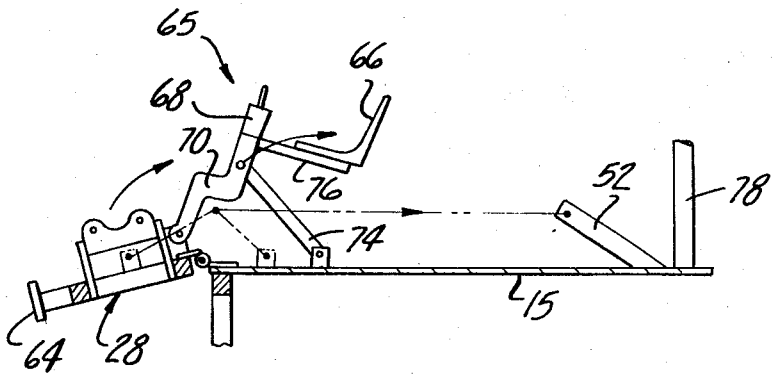
FIG. 4 is a partial side view further showing movement of the operator's seat.

With reference to FIG. 1, a pick-up truck is generally shown at 10 having a backhoe assembly 12 movably mounted on a sub-frame bed 15, which is mounted to the normal bed 13 (FIG. 3) within the truck's cargo area 14 by conventional fasteners such as bolts or the like. In the preferred embodiment, the backhoe is of the conventional type having a boom 16 controlled by a boom hydraulic cylinder 18; a dipper stick 20 controlled by a dipper stick hydraulic cylinder 22; and a bucket 24 controlled by a bucket hydraulic cylinder 26.

Boom 16 is operatively supported by a pivot frame 28 which has opposed side members 30 interconnected by upper and lower cross members 32 and 33 respectively. A mounting bracket 34 which operatively supports boom 16 and a yoke 36 which operatively supports bracket 34 are connected between cross members 32 and 33. Swing cylinders 38 are connected to bracket 34 to swing boom 16 about the vertical axis defined by pivot pin 37.

Hinge means 40 are connected between frame 28 and sub-frame bed 15, as illustrated in FIGS. 1 through 5, for permitting frame 28 to pivot between a position where the opposed side members 30 are extending vertically downwardly from bed 15 and a position where opposed side members 30 are extending vertically upwardly with respect to bed 15. In this manner, boom 16 may be pivoted between the transport position shown in FIGS. 1 and 5 to a use position or working position shown in FIGS. 2 and 3.

Linkage assemblies 44, including hydraulic cylinders 46, are connected to each member 30 for controlling the pivotal movement of frame 28. Each linkage assembly 44 has a first set of links 48 connected between member 30 and the piston end of hydraulic cylinder 46 and a second set of links 50 connected between the piston end of cylinder 46 and bed 15. The cylinder end of hydraulic cylinder 46 is pivotally supported by a bracket 52 which is fixed to bed 15. In this manner, by retracting hydraulic cylinder 46, frame 28 is pivoted about the transverse axis formed by hinge means 40 between the use and transport positions.

A fixed retaining frame 54 is fixedly attached to and extends downwardly from bed 15 to prevent frame 28 from pivoting beyond a substantially vertical position. In the preferred embodiment, frame 54 has opposed side members 58 corresponding to the opposed side members 30 of frame 28 and cross members 60 corresponding to cross members 32 and 33 of frame 28. A brace 62 attached to the underside of the truck cargo bed 63 (FIG. 3) braces retaining frame 54 against the frame of truck 10. Additionally, frame 28 is supported in a vertical position by stabilizers 64 which are extendable between the frame and the ground.

To control the movement of backhoe assembly 12 between the use and transport positions and to operate the backhoe in the use position, an operator's station 65 is provided having an operator's seat 66 and a control panel 68. Control panel 68 is supported upon a stand 70 which is pivotally connected at the one end to upper cross member 32 of frame 28 with cantilevered member 76 supporting seat 66. A brace member 74 is pivotally attached at one end to stand 70 and pivotally attached at the opposite end to bed 15. As is apparent from FIGS. 3 through 5 as frame 28 is pivoted from the use position to the transport position, operator station 65 is raised and moved forwardly toward cab 11. When frame 28 is pivoted from the transport position to the use position operator's station 65 moves rearwardly and away from cab 11. In this manner, operator station 65 is always in a position permitting a clear view of the backhoe.

A further feature of the present construction resides in the vertical boom support rack 78 which supports the boom 16 in the transport position and allows the boom to be locked in place.

It will be apparent to those skilled in the art that the foregoing disclosure is explanatory in nature rather than limiting, the invention being limited only by the appended claims.

What is claimed is:

1. An implement mounting system for use on a truck having an open cargo bed, said implement mounting system comprising:

a sub-frame mounted on said truck bed;

a support frame pivotally mounted to said sub-frame adjacent a rear portion of said bed, said support frame having opposed side members and pivot means operatively supporting a boom, said frame being pivotable between a use position wherein said side members extend downwardly substantially perpendicular to said bed with said boom extendable rearwardly for use and a transport position wherein said side members extend upwardly substantially perpendicular to said bed with said boom being foldable over said bed for transport;

at least one linkage means interconnected between said sub-frame and said support frame, said likage means having first and second link members pivotally joined at one end with the opposite end of said first link member being pivotally connected to said sub-frame and the opposite end of said second link member being pivotally connected to one of said side members;

a piston cylinder connected at one end to said one end of said linkage members and pivotally connected at the opposite end to said sub-frame, said cylinder operable to push and pull the support frame between said use and said transport positions; and a control station positioned adjacent the rear of said truck bed operatively controlling said implement in both said use and transport positions and operatively controlling said support frame between said use and transport positions.

2. The implement mounting system of claim 1 further comprising a brace member extending vertically downwardly from said sub-frame, said brace member limiting pivotal movement of said support frame when said support frame is in said use position.

3. The implement mounting system of claim 1, wherein said support frame further comprises opposed cross-members interconnecting said side members;

said cross members supporting a yoke approximately mid-way between said members;

said yoke supporting said boom such that said boom is universally pivotable with respect to said support frame.

4. The implement mounting system of claim 2, wherein said brace member comprises opposed side members interconnected by cross members, said side members being contiguous with said side members of said support frame when said support frame is in the use position.

5. The implement mounting system of claim 1, wherein said control station comprises a control panel for contolling movement of said boom and said support frame and an operator's seat for supporting an operator adjacent said panel;

said panel and seat being mounted upon a support member pivotally connected to said support frame and having a brace member pivotally connecting said support member and said sub-frame;

whereby said seat and panel pivot upwardly and forwardly with respect to said bed as said frame is pivoted from said use position to said transport position and said seat and panel pivot rearwardly and downwardly with respect to said bed as said frame is pivoted from said transport position to said use position wherein interference is prevented between said control station and said boom as said boom is pivoted between said use and transport positions.

* * * * *